US008998378B2

(12) United States Patent
De Smet et al.

(10) Patent No.: US 8,998,378 B2
(45) Date of Patent: Apr. 7, 2015

(54) INK JET PRINTING METHOD AND PRINTER

(71) Applicant: OCE-Technologies B.V., Venlo (NL)

(72) Inventors: Sebastian P. R. C. De Smet, Venlo (NL); Jos De Jong, Wijchen (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 13/796,714

(22) Filed: Mar. 12, 2013

(65) Prior Publication Data

US 2013/0187973 A1 Jul. 25, 2013

Related U.S. Application Data

(63) Continuation of application No. PCT/EP2011/066840, filed on Sep. 28, 2011.

(30) Foreign Application Priority Data

Oct. 7, 2010 (EP) ..... 10186868

(51) Int. Cl.

| | |
|---|---|
| ***B41J 29/393*** | (2006.01) |
| ***B41J 2/045*** | (2006.01) |
| ***B41J 2/205*** | (2006.01) |
| ***B41J 2/21*** | (2006.01) |
| *B41J 2/165* | (2006.01) |

(52) U.S. Cl.

CPC ..... *B41J 2/0451* (2013.01); *B41J 2/16526* (2013.01); *B41J 2/2052* (2013.01); *B41J 2/2139* (2013.01)

(58) Field of Classification Search

USPC ..... 347/13, 19

See application file for complete search history.

(56) References Cited

U.S. PATENT DOCUMENTS

| | | | | |
|---|---|---|---|---|
| 5,659,342 | A * | 8/1997 | Lund et al. | 347/35 |
| 7,393,077 | B2 | 7/2008 | Kusakari | |
| 7,537,308 | B2 * | 5/2009 | Yamane | 347/35 |
| 2003/0035030 | A1 | 2/2003 | Hamamoto et al. | |
| 2005/0030327 | A1 | 2/2005 | Tatsumi | |
| 2005/0057591 | A1 * | 3/2005 | Konno | 347/13 |
| 2010/0302327 | A1 * | 12/2010 | Tsukamura | 347/86 |

FOREIGN PATENT DOCUMENTS

| | | | |
|---|---|---|---|
| DE | 10 2007 035 805 | A1 | 2/2009 |
| EP | 1 384 585 | A1 | 1/2004 |
| JP | 2-003327 | A | 1/1990 |
| JP | 2009-239853 | A | 10/2009 |

* cited by examiner

*Primary Examiner* — Matthew Luu
*Assistant Examiner* — Lily Kemathe
(74) *Attorney, Agent, or Firm* — Birch, Stewart, Kolasch & Birch, LLP

(57) ABSTRACT

In an ink jet printing method, a recording medium is moved relative to a print head having a plurality of nozzles, and ink droplets are ejected from the nozzles onto the recording medium in a single pass in accordance with print data supplied to the print head. Spit pattern data is included in the print data A location of an expected ink dot ejected according to the spit pattern data is scanned, providing a scanned image, and such ink dot is searched for in the scanned image in order to determine an actual presence of the ink dot.

13 Claims, 1 Drawing Sheet

INK JET PRINTING METHOD AND PRINTER

CROSS-REFERENCE TO RELATED APPLICATIONS

This application is a Continuation of International Application No. PCT/EP2011/066840, filed on Sep. 28, 2011, and for which priority is claimed under 35 U.S.C. §120, and which claims priority under 35 U.S.C. §119 to Application No. 10186868.5, filed in Europe on Oct. 7, 2010. The entirety of each of the above-identified applications is expressly incorporated herein by reference.

BACKGROUND OF THE INVENTION

1. Field of the Invention

The present invention relates to an ink jet printing method, wherein a recording medium is moved relative to a print head having a plurality of nozzles, the method comprising the steps of adding spit pattern data to print data to be printed by the print head, supplying the print data and the added spit pattern data to the print head, and ejecting ink droplets from the nozzles onto the recording medium in accordance with the print data and the spit pattern data in a single pass of the recording medium along the print head.

2. Background of the Invention

In ink jet printing, nozzle failures may be caused by nozzle clogging, contamination of a plate in which the nozzles are formed, events in which the nozzles are touched by the recording medium, and the like. Such nozzle failures are a serious threat to reliable ink jet printing and to print quality.

In a single pass print process, the print head and the recording medium are moved relative to one another in such a manner that each location on the recording medium is exposed to the nozzles of the print head only once. When the width of the print head is at least as large as the width of the recording medium, the recording medium may be moved past the print head in a uniform direction, or, conversely, the print head may be moved over the recording medium only once. When the print head does not cover the entire width of the recording medium, it is moved in a main scanning direction across the paper so as to print one or more lines, and the paper is then advanced in a sub-scanning direction, so that another swath of the image will be printed in the next pass of the print head. Such a single pass process is particularly vulnerable to nozzle failures because there are only limited possibilities to compensate nozzle failures by printing extra dots with other, still intact nozzles of the print head.

It is known that the risk of nozzle failures increases when a nozzle is inactive for a certain time, because the ink may dry-out in the nozzle. DE 10 2007 035 805 A1 proposes a multi-color ink jet printing method of the type specified in the opening paragraph, wherein the risk of nozzle failure is reduced by causing the nozzles to "spit" onto the recording medium from time to time even when the print data do not command a dot to be printed. In order to hide the extra dots from human perception as far as possible, the spit pattern is designed such that each extra dot will be superposed with a dot that is printed in another color, so that the extra dot is covered by a "regular" dot, or at least the extra dot does not significantly change the visual impression, because an ink dot, though in a different color, would have to be present at the dot location, anyway.

Another approach to improve reliability in ink jet printing involves an automatic nozzle failure detection, which permits taking measures for removing the nozzle failure before a larger number of defective images is printed. For example, nozzle failure may be detected by printing a test pattern and then inspecting the test pattern from time to time. However, this method implies a waste in paper and ink, especially when the test is repeated in short intervals. Moreover, this method requires a sheet disposal trajectory in the paper pass of the printer, so that the sheets carrying the test pattern may be disposed.

Another method of nozzle failure detection involves inspecting the image that has been printed in accordance with the print data. This has the advantage that a nozzle failure can be detected immediately, and the running print process may be stopped, if necessary. However, depending on the nature of the print data, it may be difficult to detect nozzle failures, and when a nozzle failure occurs at a nozzle that is not currently used for printing, the failure cannot be detected before the nozzle is used again.

U.S. Pat. No. 7,393,077 B2 discloses a method of nozzle failure detection wherein, in a first step, only specific ink dots that shall be used for nozzle failure detection are printed on the recording medium, these ink dots are then inspected for the purpose of nozzle failure detection, and then the inspected area of the image is moved past the print head in a second pass so as to print the rest of the image in accordance with the print data. Consequently, this method requires a multi-pass print process. It is further observed in this document that the dots for nozzle failure detection do not have to form part of the image to be printed in accordance with the print data, but should in any case be located in a low visibility area of the image, especially an area in which the spatial frequency of the image to be printed is within a certain range.

SUMMARY OF THE INVENTION

It is an object of the present invention to improve the reliability of ink jet printing.

This object is achieved by an ink jet printing method, wherein a recording medium is moved relative to a print head having a plurality of nozzles, said method comprising the steps of: a) adding spit pattern data to print data to be printed by the print head; supplying the print data and the added spit pattern data to the print head; ejecting ink droplets from the plurality of nozzles onto the recording medium in accordance with the print data and the spit pattern data in a single pass of the recording medium along the print head; scanning a location of an expected ink dot ejected according to the spit pattern data by a nozzle of the plurality of nozzles, thereby providing a scanned image; analyzing the scanned image in order to determine an actual presence of the expected ink dot; and if it is determined that the expected ink dot is absent, applying nozzle failure correction during the same pass for the nozzle intended to eject the ink dot with respect to the ink droplets that still have to be ejected onto the recording medium and were intended to be ejected by the nozzle.

The present invention is based on the idea of combining nozzle failure prevention and nozzle failure detection. Thus, the dots formed on the recording medium in accordance with the spit pattern data have the twofold purpose of, first, preventing nozzle failures by shortening the intervals in which the nozzles are inactive and, second, detecting nozzle failures by verifying whether or not the dots according to the spit pattern data are actually present at the locations specified by the spit pattern data. The dots corresponding to the print data including the spit pattern data may be printed in the same pass of the print head, so that the present invention is applicable to the highly efficient single-pass print process. Since the locations on which ink dots according to the spit pattern data are expected, are specified, there is no need to scan the complete printed image, although in an embodiment the complete recording medium is scanned and the locations are retrieved from the scanned image.

By applying the method according to the present invention, a misdirecting or failing nozzle may be detected in an early stage, namely when the analysis of the scanned image has been completed. A failing nozzle is at that moment identified and the print head will take this information into account, even before ink dots that were intended to be ejected by the failing nozzle are printed. Nozzle failure correction, for example compensation by other nozzles, may be applied in the same single pass.

The present invention also relates to an ink jet printer adapted for carrying out this method.

More specific of the features and further developments of the present invention are indicted in the dependent claims.

Preferably, the spit pattern data accomplish an isolated ink dot to be printed in the background of an image to be printed on the recording medium according to the print data, i.e. in areas on the recording medium where the print data do not specify any dots to be printed. This has the advantage that the isolated dot on the background can more easily and reliably be detected in the process of image scanning and electronic processing of the scanned image, in particular since the expected position of the isolated ink dot is known in advance from the spit pattern data. Moreover, since the dot is isolated in the sense that no other dots are found in the vicinity of a given dot according to the spit pattern data, the particular nozzle that is responsible for a missing dot according to the spit pattern data can be identified more reliably, so that the method is robust against register errors between printing and scanning.

Another advantage is that, even when a nozzle is not needed for printing the print data during a long period of time, it will nevertheless be activated from time to time in accordance with the spit pattern data, and this offers the possibility to detect nozzle failure even before the nozzle is needed again.

On the other hand, considering the typical size of ink dots in an image printed with a resolution of, e.g. 300 dpi or more, the isolated dot on the background is so small that it is hardly perceptible with the human eye and, consequently, does not disturb the printed image.

In color printing, spit pattern data may be defined for each color component, and the dots according to the spit pattern data may comprise dots located in the background of the color image as a whole or dots located in the background of the respective color separation image. In the latter case, the dot according to the spit pattern data may be surrounded or even overlapped by adjacent dots in other colors. This reduces the visibility of the dot according to the spit pattern data for a human viewer, but may on the other hand require a color sensitive scanner for detection of the dot. When the dots according to the spit pattern data are located only in the background of the entire color image, a monochromatic scanner may be sufficient for detecting these dots.

The spit pattern data may be static in the sense that it does not depend upon the nature of the print data. In a preferred embodiment, however, the spit pattern data is dynamically changed dependent on the print data. In this case, the spit pattern data may be designed to activate only those nozzles that have not been used in the regular print process for a certain time. On the other hand, it may be the advantageous when even those nozzles that have frequently been used in the regular print process are caused to spit onto the background from time to time, though with a reduced frequency, only for the purpose of reliable nozzle failure detection, so that one can be sure that this nozzle is still working.

On the other hand, once a nozzle failure has been detected, the spit pattern data may be modified to cause the defective nozzle to spit more frequently, because a nozzle failure, especially when it is caused by clogging of the nozzle, may sometimes be removed by repeatedly activating the nozzle again.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
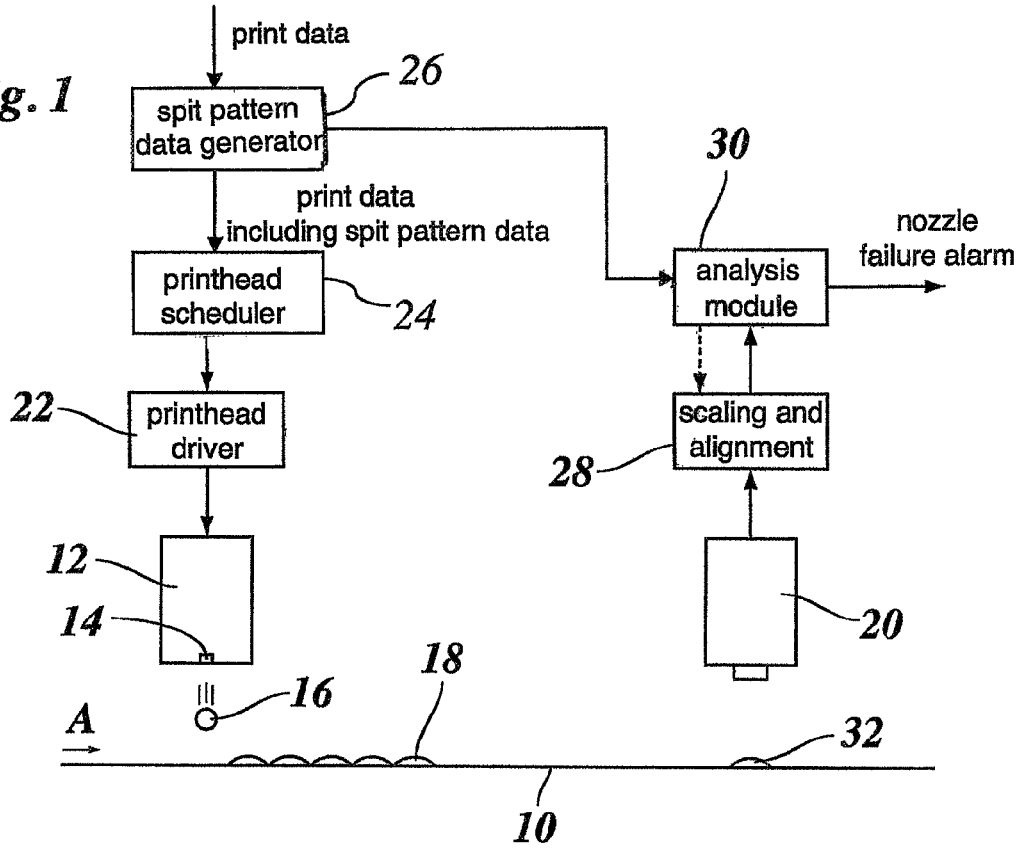
FIG. 1 is a block diagram showing essential parts of an ink jet printer according to the present invention.

The present invention will now be described with reference to the accompanying drawings, wherein the same or similar elements are identified with the same reference numeral.

As is shown in FIG. 1, a recording medium 10, e.g. a sheet of paper, is moved with a constant speed in the direction of an arrow A by means of a transport mechanism, that has not been shown. A print head 12 having a plurality of nozzles 14 is disposed above the path of the recording medium 10 and extends over the entire width of the recording medium (in the direction normal to the plane of the drawing in FIG. 1). As is generally known in the art, the nozzles 14 have actuators configured to cause the nozzles to eject ink droplets 16 onto the recording medium 10 so as to print an image composed of ink dots 18 in accordance with print data supplied to the print head. The nozzles 14 are arranged in one or more lines across the width of the recording medium in a certain raster that defines the print resolution, so that, within this raster, an ink dot 18 may be formed in any width wise position of the recording medium. The positions of the ink dots 18 on the recording medium in the medium transport direction A are determined by the timings with which the individual nozzles are fired when the recording medium 10 moves past the print head. In a color printer, the print head 12 will include a suitable array of nozzles 14 for each color.

A scanner 20 is disposed downstream of the print head 12 in the transport direction A and may be formed by a single-line (monochromatic) CCD-based or CMOS-based camera that also extends over the entire width of the recording medium 10. When the recording medium 10 moves past the scanner 20, the expected location of an ejected ink dot according to the spit pattern data is scanned, so that the presence or absence of an ink dot according to the spit pattern data on the location may be verified. In general, when an ink dot should have been printed at an expected location, but cannot be detected with the scanner 20, this indicates that the corresponding nozzle 14 has failed. This failure could be complete failure, i.e. no ink droplet emitted by the nozzle, or could be a misdirected ink droplet that lands away from the expected location.

Print data that specify the image to be printed are supplied to a print head driver 22, which causes the individual nozzles 14 of the print head to fire at appropriate timings. By way of example, it may be assumed that the nozzles 14 or their actuators are capable of firing synchronously with a certain frequency, so that a pixel line of dots 18 is formed on the recording medium 10 in each cycle. However, other printing strategies may be applied.

In the example shown, the print data are first supplied to a spit pattern data generator 26. This spit pattern data generator determines a pattern of dots 32 that shall be printed on the recording medium 10 in order to assure that each of the nozzles 14 of the print head will be activated from time to time so as to limit the interval in which the nozzle has been inactive. This interval is selected such that the ink is prevented from drying out in the nozzle and causing a nozzle failure. The spit pattern data is included in the print data. The print data including the spit pattern data are supplied to a print head scheduler 24 which specifies for each operating cycle of the print head 12 which of the nozzles 14 has to be actuated. The print head scheduler 14 will then send corresponding instructions to the print head driver 22. Further, the print head scheduler 24 sends the information on which nozzle 14 will fire or has fired at which time to the spit pattern data generator 26. Instruction signals are sent from the print head scheduler 24 to the print head driver 22, so that the image that is actually printed with the print head 12 consists of an image specified by the print data including the spit pattern data.

The resolution of the scanner 20 may be different from the resolution of the print head 22. This is why the image recorded by the scanner 22 is sent to a scaling and alignment unit 28 where the resolution of the scanner 20 is matched with the resolution of the print head. Further, the scaling and alignment unit 28 serves for correcting any possible misalignment between the print head and the scanner.

The scanned image that has been processed in the scaling and alignment unit 28 is forwarded to an analysis module 30, which also receives the spit pattern data generated by the spit pattern data generator 28. The analysis module 30 analyzes those areas in the scanned image where a dot 32 should be present according to the spit pattern data. When the dot 32 according to the spit pattern data is actually found, it is concluded that the nozzle 14 that has printed this dot is still functioning. On the other hand, when no dot 32 according to the spit pattern data is found in the search area, it is concluded that the corresponding nozzle has failed, and a nozzle failure alarm is sent to a main control unit of the printer, so that the print process may be stopped or measures may be taken for removing or camouflaging the nozzle failure.

In the example shown, the analysis module 30 searches only for the dots 32 that form the spit pattern. In a modified embodiment, the analysis module 30 may also receive the data from the print head scheduler 24 to verify whether the regular dots 18 corresponding to the print data before including the spit pattern data have actually been printed. However, when the image to be printed contains solid areas in black (or any other color), where the dots 18 are directly adjacent to another and even partly overlap, the nozzle failure may create only a very small gap, which is difficult to detect with sufficient reliability. Moreover, even when such a gap is detected, it is difficult to decide which of the nozzles 14 is responsible for this gap, because even the scaling and alignment unit 28 will only be capable of correcting alignment errors with a certain accuracy.

Figure 2:
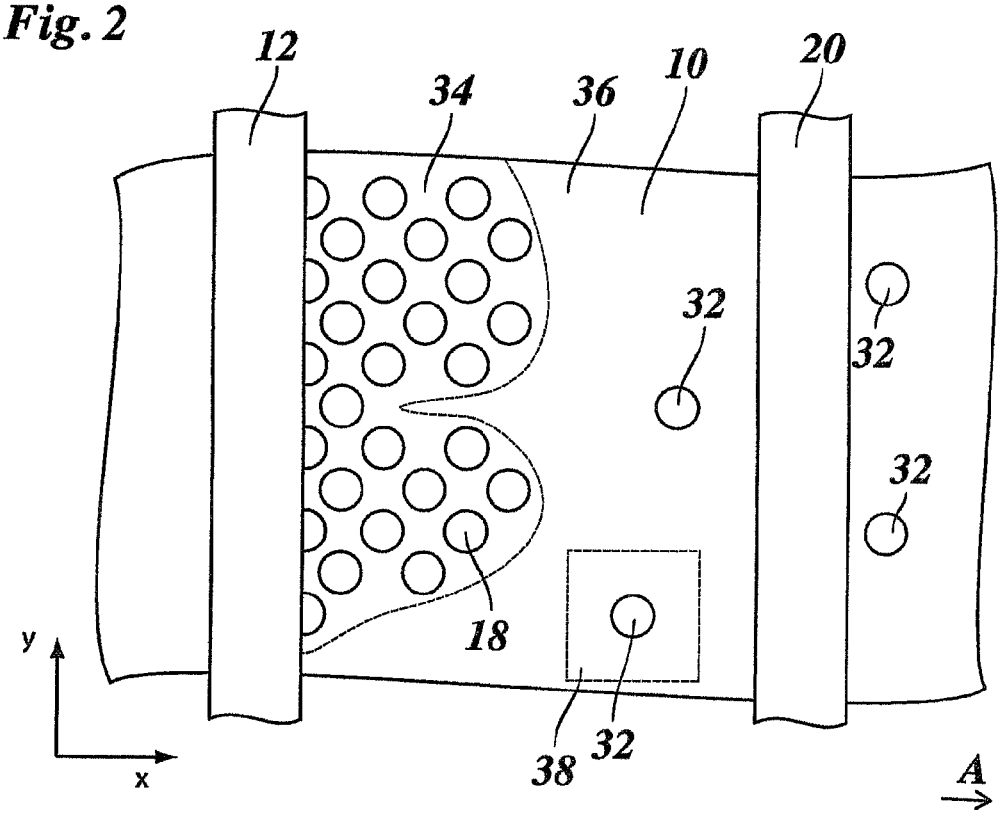
FIG. 2 is a schematic top plan view of parts of a recording medium with a dot pattern thereon and of parts of a print head and a scanner of a printer.

As has schematically been shown in FIG. 2, the print head 12 has printed an image on the recording medium 10. For simplicity, it shall be assumed here that the print head 12 prints only with black ink. A dashed line in FIG. 10 separates an image area 34 on the recording medium 10 from a background area 36. The image area 34 is filled with dots 18 that have been printed in accordance with the print data being not part of the spit pattern data. The background area 36 is mainly formed by the (white) background of the recording medium, but also includes a spit pattern of loosely scattered dots 32. The positions of the loosely scattered dots 32 have been determined by the spit pattern data generator 26 by means of an algorithm, the general principles of which will now be outlined.

Since it is the main purpose of the spit pattern to assure that none of the nozzles 14 remains inactive for an excessively long period of time, regardless of the contents of the print data, the spit pattern data generator monitors and stores the history of each of the nozzles 14 and particularly stores the time when each nozzle has printed its last dot. For each nozzle 14, the spit pattern data generator 26 counts the time in which the nozzle has been inactive, and when this time reaches a certain limit, the nozzle is scheduled for spitting a dot 32.

However, the constraint is that the dot 32 shall have a predetermined minimum distance from other dots 32 that have already been printed according to the spit pattern data, and preferably also from the image area 34. Thus, when two nozzles 14 that are separated only by a small distance in the print head 12 reach the limit of their inactive period approximately at the same time, only one of these nozzles will be activated for printing a dot 32, while the other nozzle will have to wait for a certain time, until the recording medium has been forwarded by a sufficient distance. In this way, it is assured that the dots 32 according to the spit pattern data are isolated and do not form any clusters that would be more readily perceptible for the human eye.

The coordinate positions of the dots 32 according to the spit pattern data in an x y coordinate system or, equivalently, the identities of the nozzles that have printed the dots 32 according to the spit pattern data and the activation times of these nozzles, are transmitted to the analysis module 30. The analysis module defines a search area 38 around and including the coordinate position of each dot 32 according to the spit pattern data. This search area 38 is dimensioned in view of the expected tolerances of alignment between the print head 12 and the scanner 20 and expected timing errors, so that, when the dot 32 has actually been printed, it will with certainty be found within the search area 38. On the other hand, since the dots 32 according to the spit pattern data have a predetermined minimum distance from one another, it is assured that no search area 38 includes more than a single dot 32 according to the spit pattern data. Consequently, it can easily and reliably be verified from each dot 32 that has been included by the spit pattern data generator 26 whether this dot has actually been printed or not. When the dot is not found in the search area 38, the nozzle 14 that is responsible for this can be identified reliably and unambiguously, and a corresponding nozzle failure alarm may be delivered.

Optionally, the nozzle failure alarm may also be transmitted to the spit pattern data generator 26 to cause the same to activate the defective nozzle more frequently in an attempt to remedy the nozzle failure. This frequency may even be higher than the frequency that would be allowed by the required minimum distance between the dots 32 according to the spit pattern data, because, as long as the nozzle fails, the dot according to the spit pattern data will not actually be printed.

When an expected dot 32 according to the spit pattern data is actually found in the search area 38, but in a position that is offset from the expected position, this offset may be fed back to the scaling and alignment unit for re-calibrating the alignment correction.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An ink jet printing method, wherein a recording medium is moved relative to a print head having a plurality of nozzles, said method comprising the steps of:

a) adding spit pattern data to print data to be printed by the print head;

b) supplying the print data and the added spit pattern data to the print head;

c) ejecting ink droplets from the plurality of nozzles onto the recording medium in accordance with the print data and the spit pattern data in a single pass of the recording medium along the print head;

d) scanning a location of an expected ink dot ejected according to the spit pattern data by a nozzle of the plurality of nozzles, thereby providing a scanned image;

e) analyzing the scanned image in order to determine an actual presence of the expected ink dot; and f) if it is determined that the expected ink dot is absent, applying nozzle failure correction during the same pass for the nozzle intended to eject the ink dot with respect to the ink droplets that still have to be ejected onto the recording medium and were intended to be ejected by the nozzle.

2. The method according to claim 1, wherein the spit pattern data is configured to control a nozzle of the plurality of nozzles to eject an isolated dot in a background area of an image to be printed on the recording medium according to the print data.

3. The method according to claim 2, further comprising the step of printing in multiple colors, wherein the spit pattern data for a given color accomplish an isolated dot in the background area of the color separation image for that color.

4. The method according to claim 2, further comprising multiple color printing, wherein the spit pattern data is configured to control a for a given color to eject an isolated dot in the background area of the entire color image.

5. The method according to claim 1, wherein the spit pattern data is configured to control a nozzle of the plurality of nozzles such that two ink dots to be ejected according to the spit pattern data have a predetermined minimum distance from one another.

6. The method according to claim 5, wherein the search for the dot in the scanned image is limited to a search area around and including the expected location of the dot as specified by the spit pattern data.

7. The method according to claim 1, further comprising the step of using an offset between the position of a dot in the scanned image and the expected location of this dot as specified by the spit pattern data for correcting the alignment of the scanned image with the print head.

8. The method according to claim 1, further comprising the step of dynamically varying the spit pattern data dependent on the contents of the print data.

9. The method according to claim 1, further comprising the step of modifying the spit pattern data, when a failure of a nozzle has been detected, to activate this nozzle more frequently.

10. An ink jet printer comprising:

a print head having a plurality of nozzles for ejecting ink droplets onto a recording medium in accordance with print data;

a transport system for moving the recording medium relative to the print head;

a control system including a spit pattern data generator causing the inclusion of spit pattern data to the print data;

a scanner arranged to scan a location of an expected ink dot ejected according to the spit pattern data, the scanner providing a scanned image; and an analysis module adapted to analyze the scanned image for the expected ink dot in order to determine an actual presence of the expected ink dot, wherein the control system is adapted to apply nozzle failure correction during the same pass for the nozzle intended to eject the ink dot with respect to the ink droplets that still have to be ejected onto the recording medium and were intended to be ejected by the nozzle, if it is determined by the analysis module that the ink dot is absent.

11. The printer according to claim 10, wherein the printer is adapted for color printing and the scanner is a monochromatic scanner.

12. The method according to claim 1, wherein the step e) of analyzing the scanned image comprises the steps of e1) defining a search area around and including a coordinate position of the expected ink dot according to the spit pattern data; and e2) analyzing the defined search area in order to determine an actual presence of the expected ink dot.

13. The printer according to claim 10, wherein the analysis module is further adapted to define a search area around and including a coordinate position of the expected ink dot according to the spit pattern data, and analyze the defined search area in order to determine an actual presence of the expected ink dot.

* * * * *